US010132093B2

(12) United States Patent
Woodruff

(10) Patent No.: US 10,132,093 B2
(45) Date of Patent: Nov. 20, 2018

(54) FRAMING TEMPLATE TOOL AND METHOD OF USING SAME

(71) Applicant: Richard L. Woodruff, Jacksonville, NC (US)

(72) Inventor: Richard L. Woodruff, Jacksonville, NC (US)

( * ) Notice: Subject to any disclaimer, the term of this patent is extended or adjusted under 35 U.S.C. 154(b) by 227 days.

(21) Appl. No.: 15/347,164

(22) Filed: Nov. 9, 2016

(65) Prior Publication Data

US 2017/0138719 A1 May 18, 2017

Related U.S. Application Data

(60) Provisional application No. 62/256,790, filed on Nov. 18, 2015.

(51) Int. Cl.
*G01B 3/24* (2006.01)
*E04G 21/18* (2006.01)
*E04B 2/80* (2006.01)

(52) U.S. Cl.
CPC ..... *E04G 21/1891* (2013.01); *E04B 2/80* (2013.01)

(58) Field of Classification Search
CPC ..... E04G 21/1891
USPC ..... 33/613, 645
See application file for complete search history.

(56) References Cited

U.S. PATENT DOCUMENTS 1,810,597 A 6/1931 Corwin
2,275,109 A 3/1942 McGee
5,245,811 A 9/1993 Knorr
5,313,752 A 5/1994 Hatzinikolas
5,953,876 A 9/1999 Agar
6,895,684 B1 * 5/2005 Firth ..... E04G 21/1891 33/562
7,310,914 B1 12/2007 Moore
7,823,350 B2 11/2010 Valle
8,448,348 B1 * 5/2013 Jones ..... E04G 21/1891 33/613
2003/0051359 A1 * 3/2003 Connor ..... B25H 7/00 33/474
2003/0145475 A1 * 8/2003 Sparkes ..... E04G 21/1891 33/474
2006/0010703 A1 * 1/2006 Gauthier ..... E04G 21/1891 33/613
2007/0011971 A1 1/2007 Sitkiewicz
2007/0144106 A1 6/2007 Kirk
2008/0053035 A1 3/2008 Rosenberg
2009/0094836 A1 4/2009 Fleeman
2010/0083519 A1 * 4/2010 Bradley ..... E04G 21/1841 33/613
2010/0126106 A1 5/2010 Ivarsson
2013/0219732 A1 * 8/2013 Jordan ..... E04G 21/1891 33/613

(Continued)

*Primary Examiner* — G. Bradley Bennett
(74) *Attorney, Agent, or Firm* — Ward and Smith, P.A.; Ryan K. Simmons

(57) ABSTRACT

A framing template tool may include a face plate; a top plate joined to the face plate at about an edge thereof, wherein the top plate is substantially orthogonal to the face plate; and alignment features. The alignment features may include slots formed in the face plate along its length; and one or more flaps joined to at least one edge of each of the slots, wherein each of the flaps protrude in a substantially orthogonal fashion from the face plate and in a direction away from the top plate.

20 Claims, 15 Drawing Sheets

(56) References Cited

U.S. PATENT DOCUMENTS

| | | | | |
|---|---|---|---|---|
| 2016/0018206 | A1* | 1/2016 | Hollis | B25H 7/02 33/354 |
| 2017/0138719 | A1 | 5/2017 | Woodruff | |

* cited by examiner

FRAMING TEMPLATE TOOL AND METHOD OF USING SAME

RELATED APPLICATIONS

This application is related to and claims priority to U.S. Provisional Patent Application No. 62/256,790, filed on Nov. 18, 2015, entitled "Framing Tool", the entire disclosure of which is incorporated herein by reference.

FIELD OF THE INVENTION

This invention pertains generally to construction and more particularly to a framing template tool and method of using the same in wall framing.

BACKGROUND OF THE INVENTION

In frame construction, 2× lumber (e.g., 2×4 or 2×6 lumber) is often used for framing. For example, when framing a wall, such as a partition wall, the 2× vertical wall studs are typically spaced 16 or 24 inches apart (on center) and then the ends of the wall studs are nailed to the sole plate (i.e., the bottom horizontal framing member) and the top plate (i.e., the top horizontal framing member). For a construction worker, the process of building from scratch, for example, a partition wall can be very time-consuming, typically requires more than one worker, and is prone to errors. For example, a common error is inconsistent stud spacing. Such errors can make the difference between quality construction and not.

BRIEF DESCRIPTION OF THE INVENTION

In one embodiment, the invention provides a framing tool. The framing tool may include a face plate; a top plate joined to the face plate at about an edge thereof, wherein the top plate is substantially orthogonal to the face plate; and alignment features. The alignment features may include slots formed in the face plate along its length; and one or more flaps joined to at least one edge of each of the slots, wherein each of the flaps protrude in a substantially orthogonal fashion from the face plate and in a direction away from the top plate. The framing tool may further include a half slot formed at each end of the face plate, wherein the half slot at each end of the face plate leaves an overhang portion on each end of the top plate. Each half slot may include a flap joined to an edge of each half slot, and wherein each flap protrudes in a substantially orthogonal fashion from the face plate and in a direction away from the top plate. Each half slot may be about half the width of the slots formed in the face plate along its length. The overhang portions may extend out about 0.75 inches from each end of the face plate. The one or more flaps may be joined to at least one vertical edge of each of the slots. The slots may include about a 16-inch on center spacing from one another. The distance from each end of the top plate to a center point of its next adjacent slot is about 16 inches or about 24 inches. The face plate may be about 3.5 inches tall, the top plate may be about 1.5 inches wide, the one or more flaps may be about 3.5 inches tall and protrude about 1.5 inches out from a surface of the face plate, and the slots may be about 1.5 inches wide. The face plate may be about 5.5 inches tall, the top plate may be about 1.5 inches wide, the one or more flaps may be about 5.5 inches tall and protrude about 1.5 inches out from a surface of the face plate, and the slots formed in the face plate may be about 1.5 inches wide. The framing tool may further include measuring indicia on at least a portion of one of the top plate and face plate. The slots may be configured and spaced for placement of 2×4 and/or 2×6 wall studs at a spacing of about 16-inches on center. The slots may be configured and spaced for placement of 2×4 and/or 2×6 wall studs at a spacing of about 24-inches on center. The slots may be configured and spaced for placement of at least one set of 2×4 and/or 2×6 wall studs at a spacing of about 16-inches on center and at least one set of 2×4 and/or 2×6 wall studs at a spacing of about 24-inches on center. An overall length of the framing tool may be one of about 16 inches, 24 inches, or 48 inches. The framing tool may include two half slots one formed at each end of the face plate, wherein the half slot at each end of the face plate leaves an overhang portion on each end of the top plate, wherein each of the two half slots comprise a flap joined to an edge of each half slot, and wherein each flap protrudes in a substantially orthogonal fashion from the face plate and in a direction away from the top plate. An overall length of the top plate may be about 16-inches and an overall length of the face plate may be about 14.5 inches. An overall length of the top plate may be about 24-inches and an overall length of the face plate may be about 22.5 inches. An overall length of the top plate may be about 48-inches and an overall length of the face plate may be about 46.5 inches.

In another embodiment, the invention provides a method of using a framing tool. The method may include providing engaging a framing tool with a horizontal framing member; engaging ends of vertical framing members with respect to the framing tool; and fastening ends of the vertical framing members to the horizontal framing member. The framing tool may include a face plate; a top plate joined to the face plate at about an edge thereof, wherein the top plate is substantially orthogonal to the face plate; and alignment features. The alignment features may include slots formed in the face plate along its length; and one or more flaps joined to at least one edge of each of the slots, wherein each of the flaps protrude in a substantially orthogonal fashion from the face plate and in a direction away from the top plate.

These and other embodiments will be apparent from the ensuing specification.

BRIEF DESCRIPTION OF THE DRAWINGS

Figure 1:
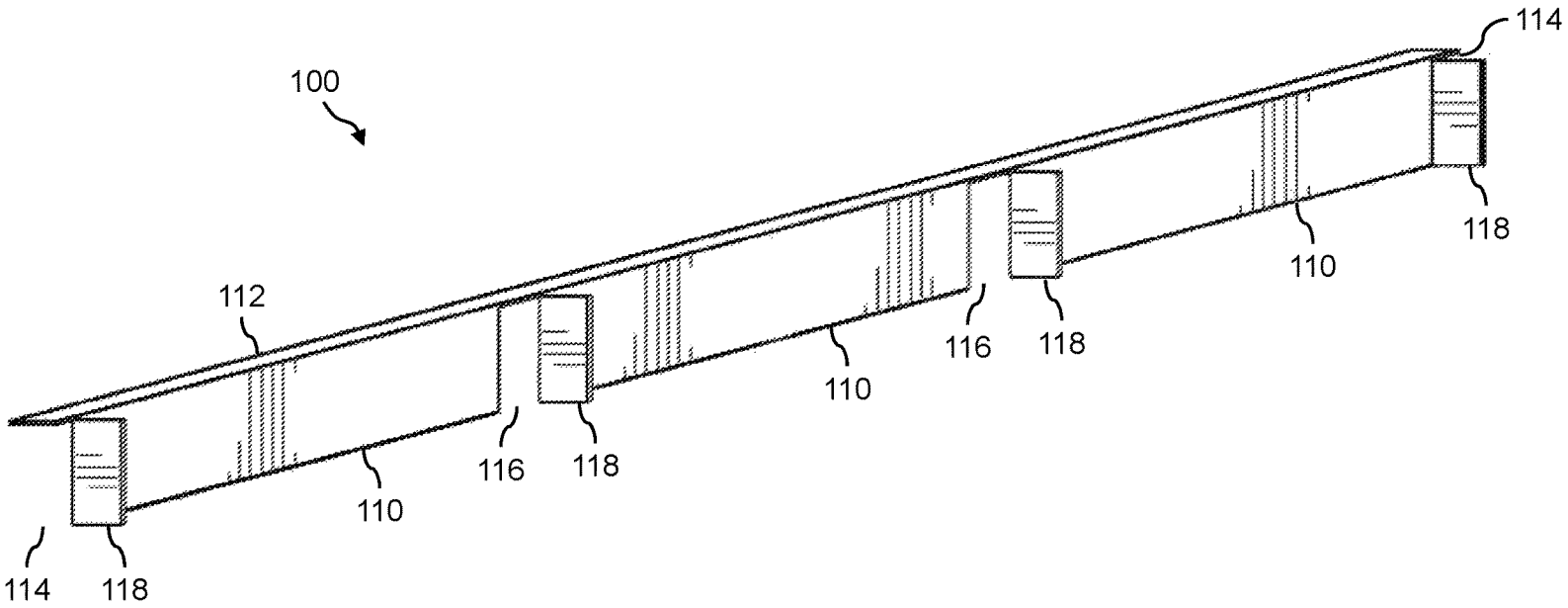
Figure 2:
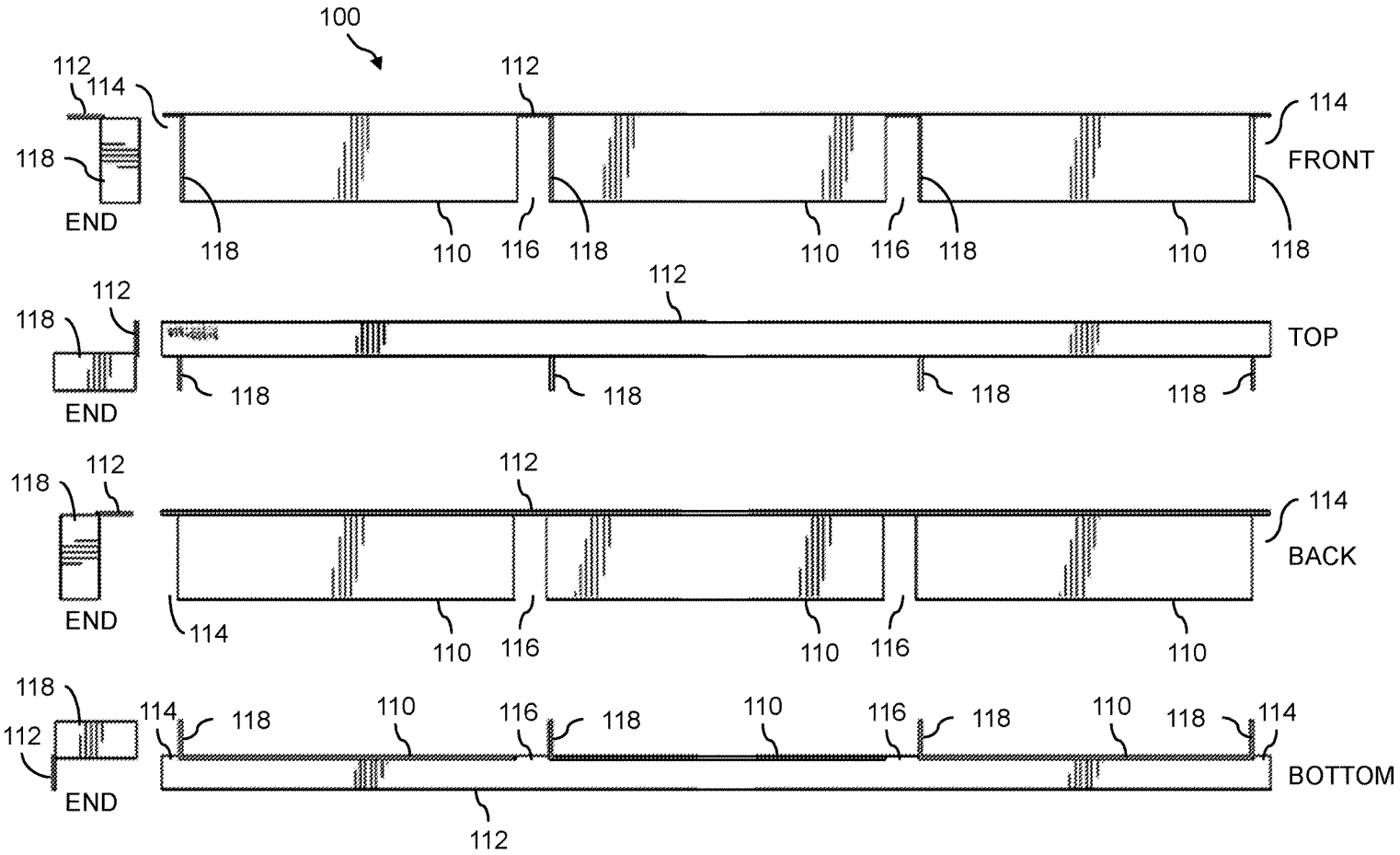
Figure 3:
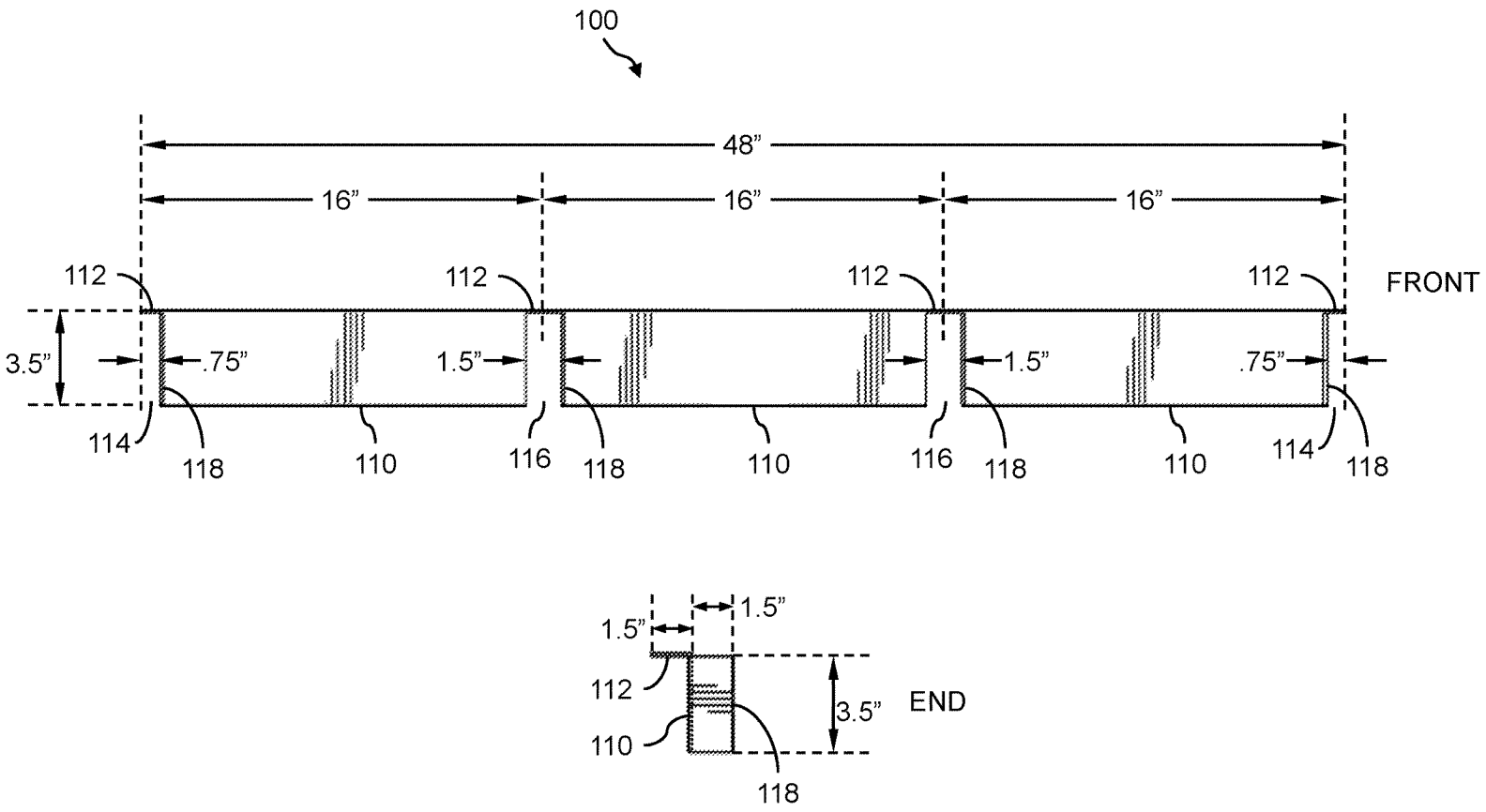
Figure 4:
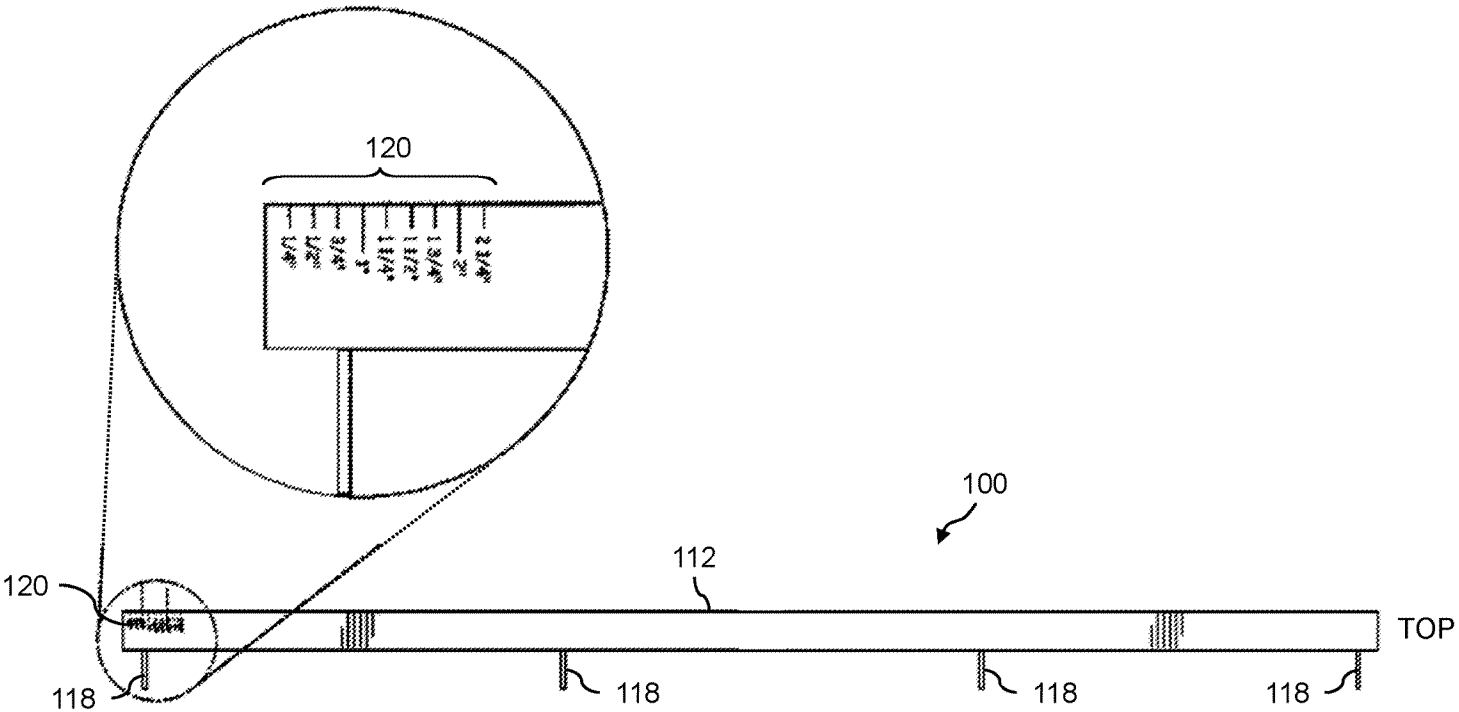
Figure 5:
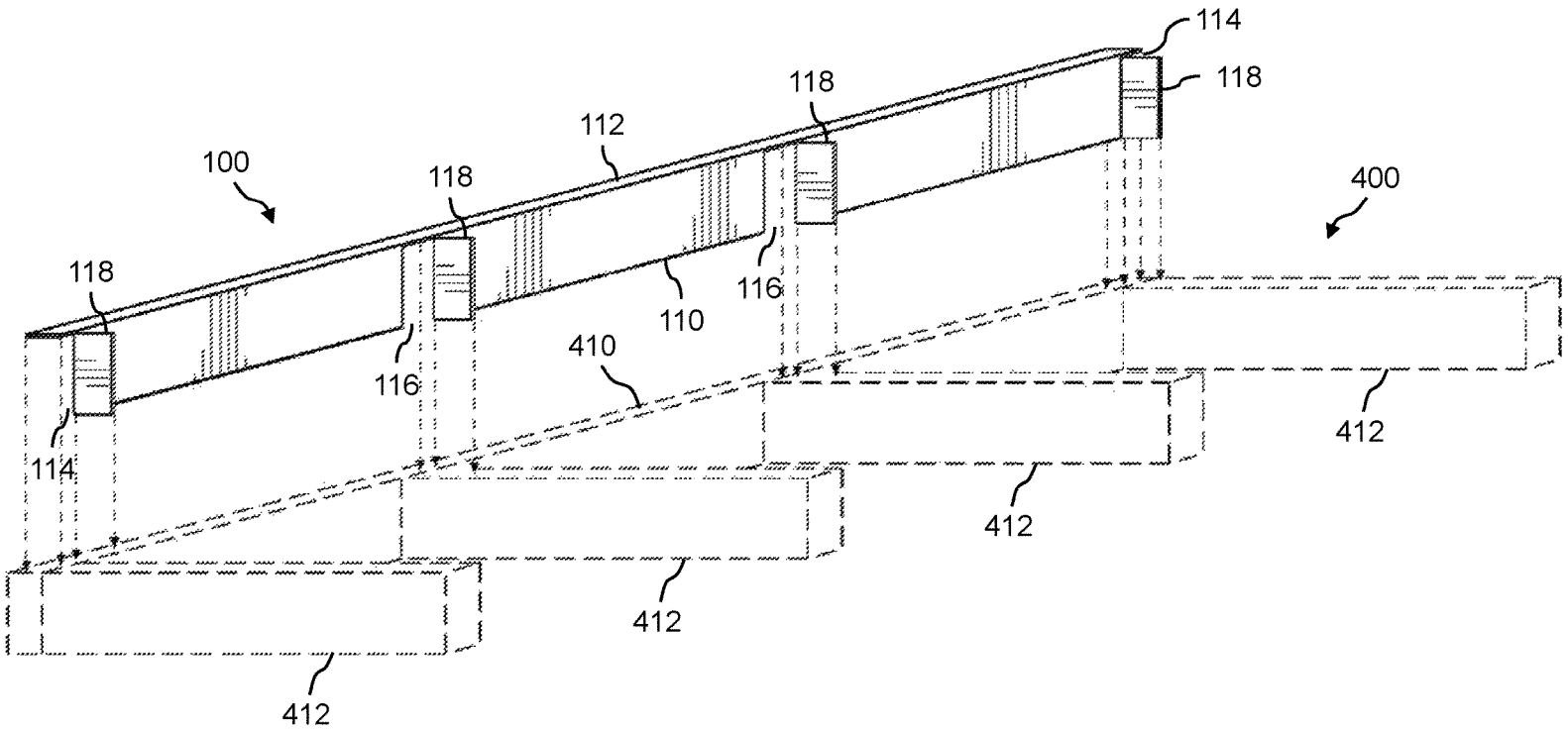
Figure 6:
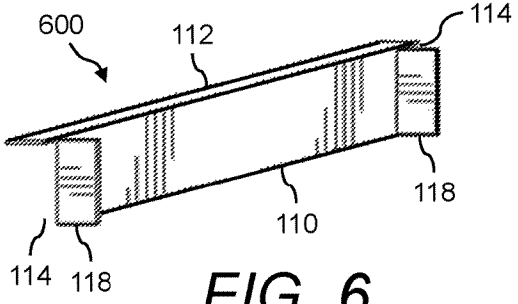
Figure 7:
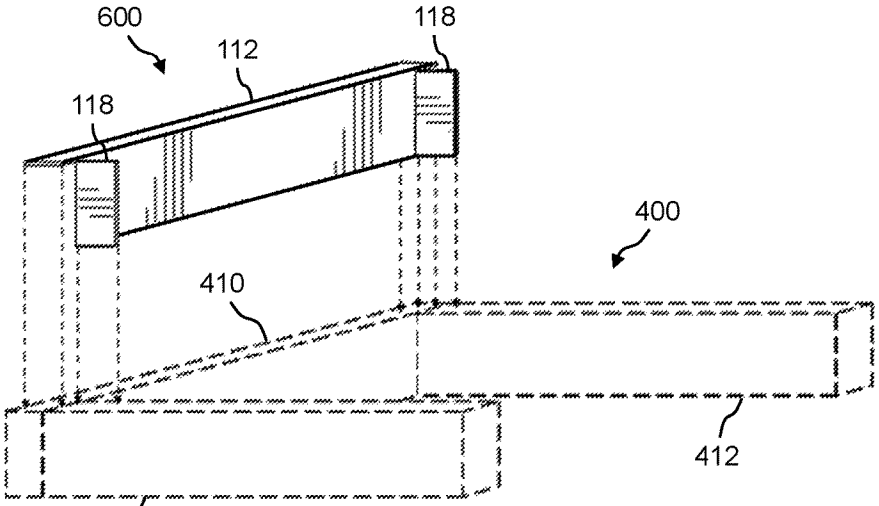
Figure 8:
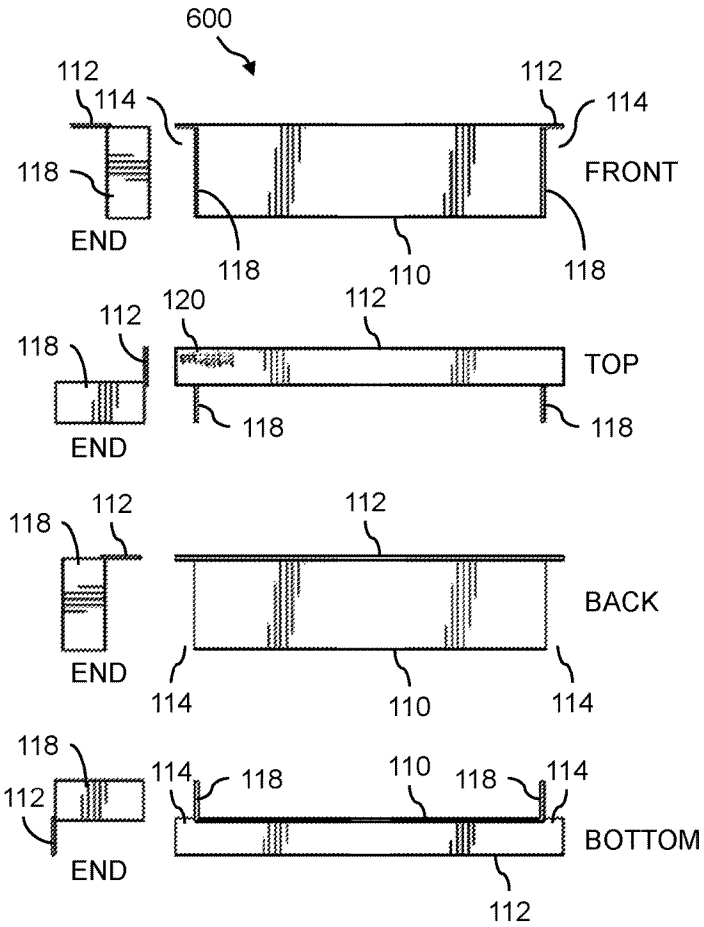
Figure 9:
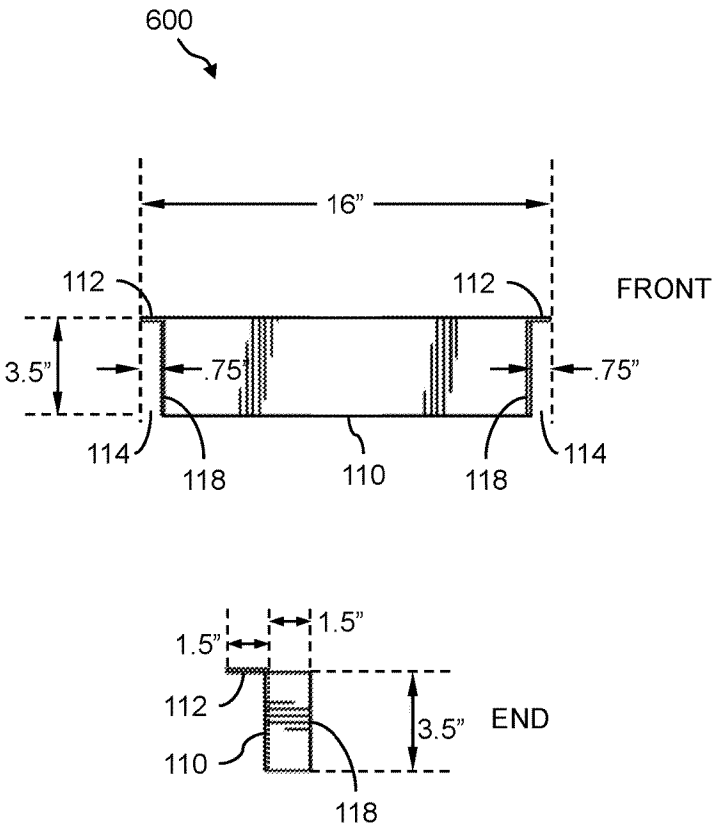
Figure 10:
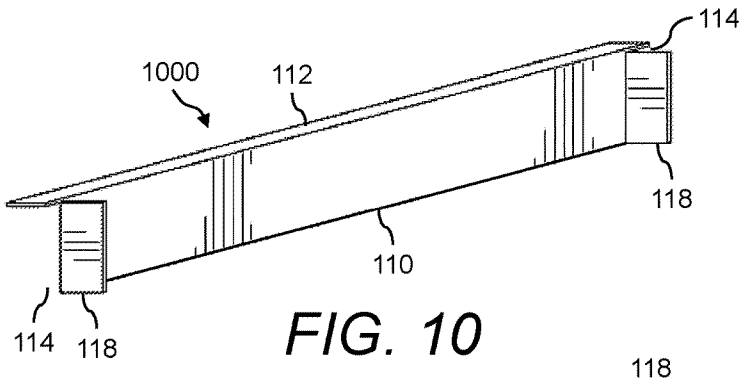
Figure 11:
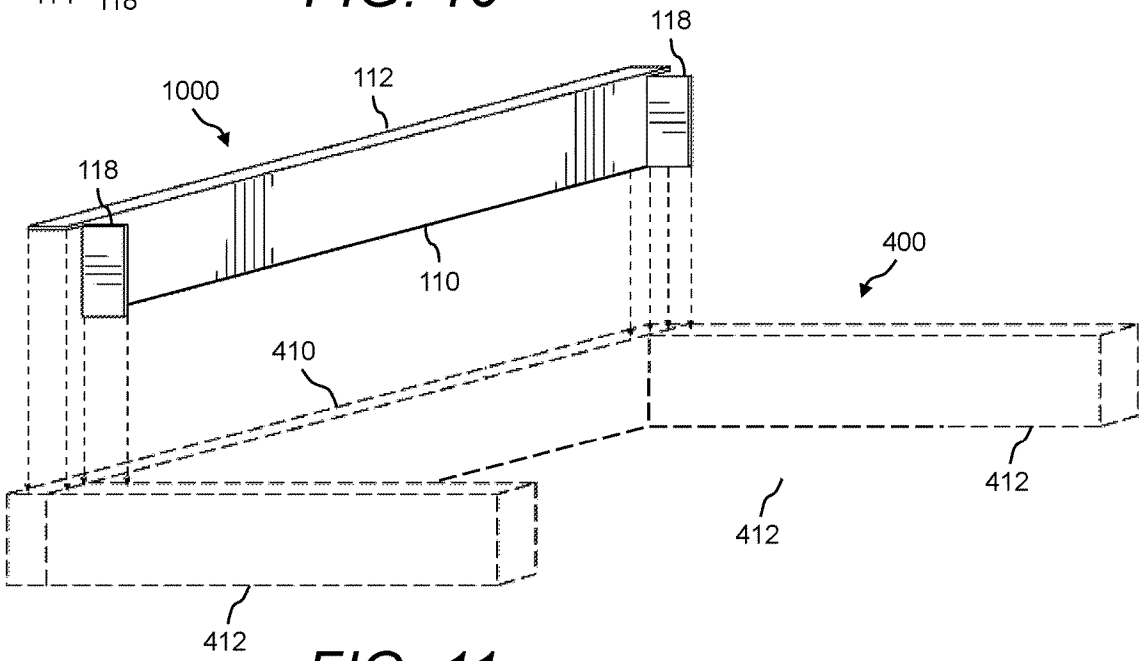
Figure 12:
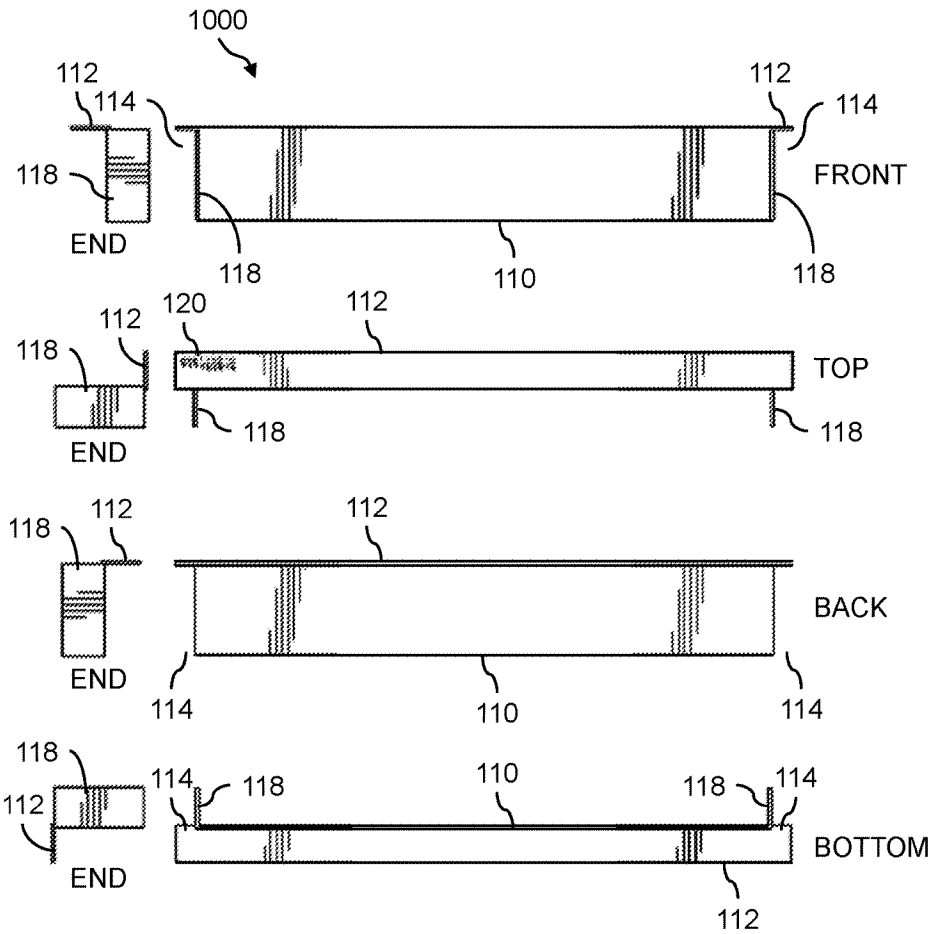
Figure 13:
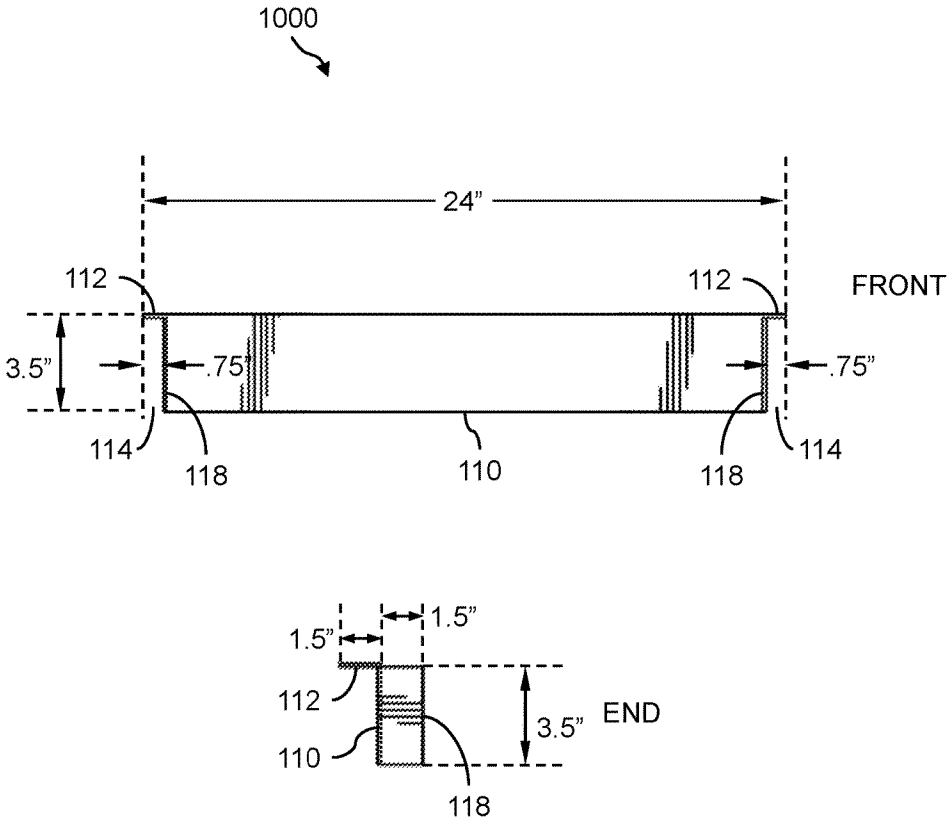
Figure 14:
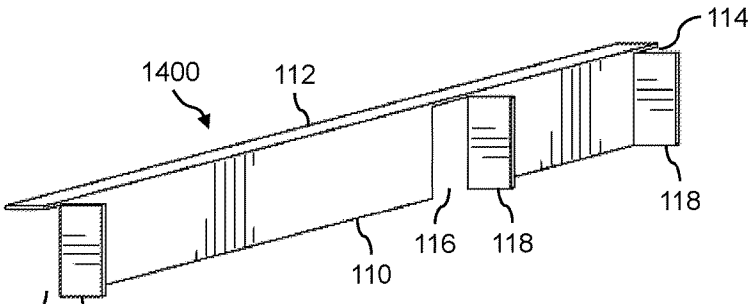
Figure 15:
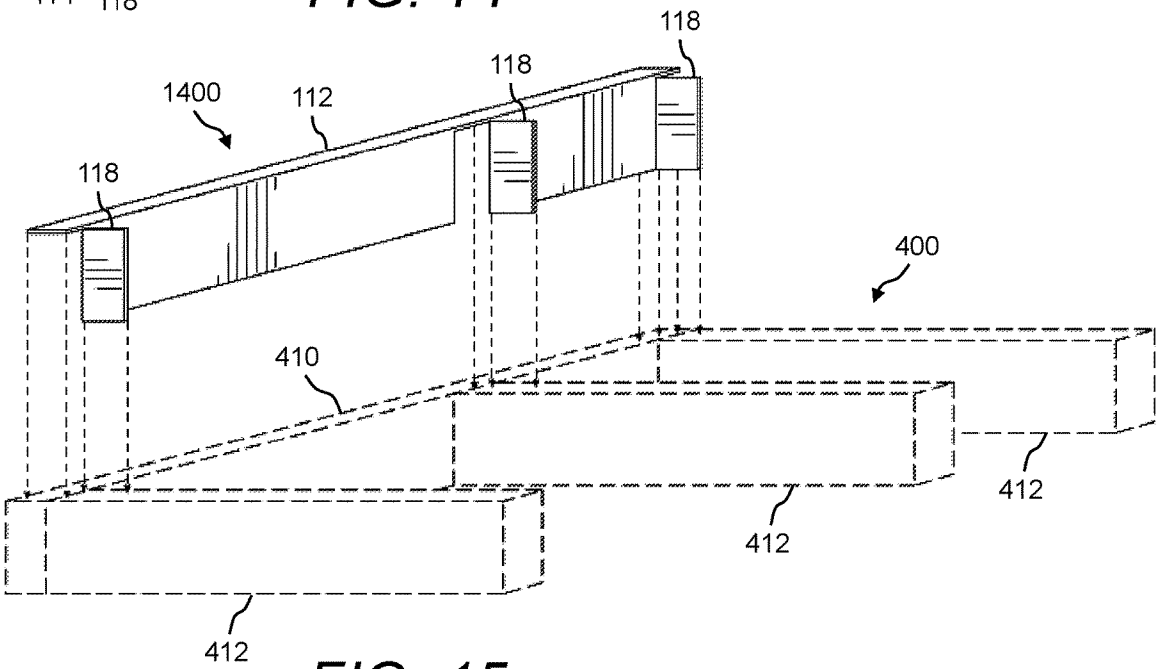
Figure 16:
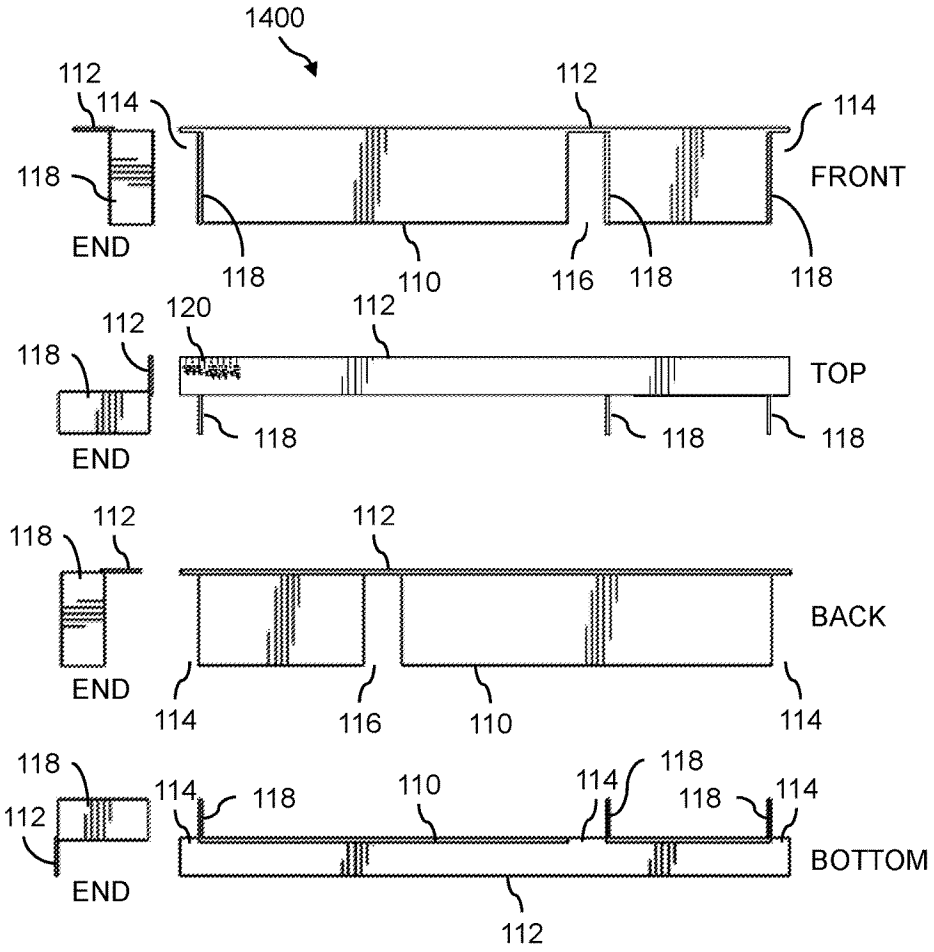
Figure 17:
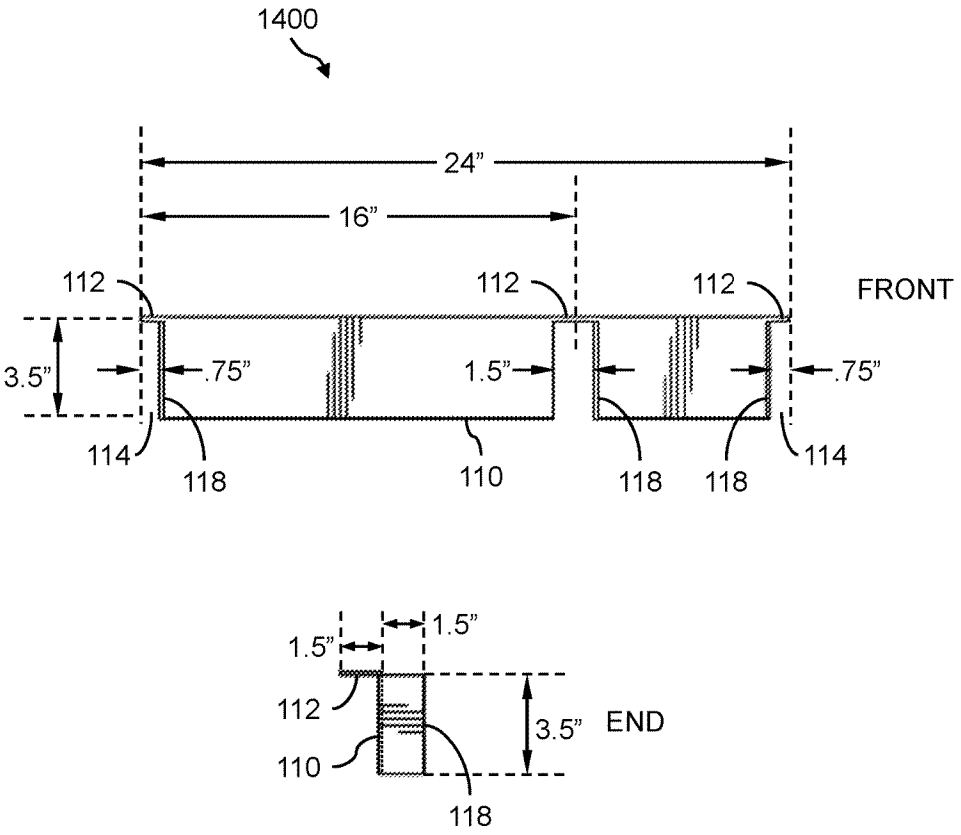
Figure 18:
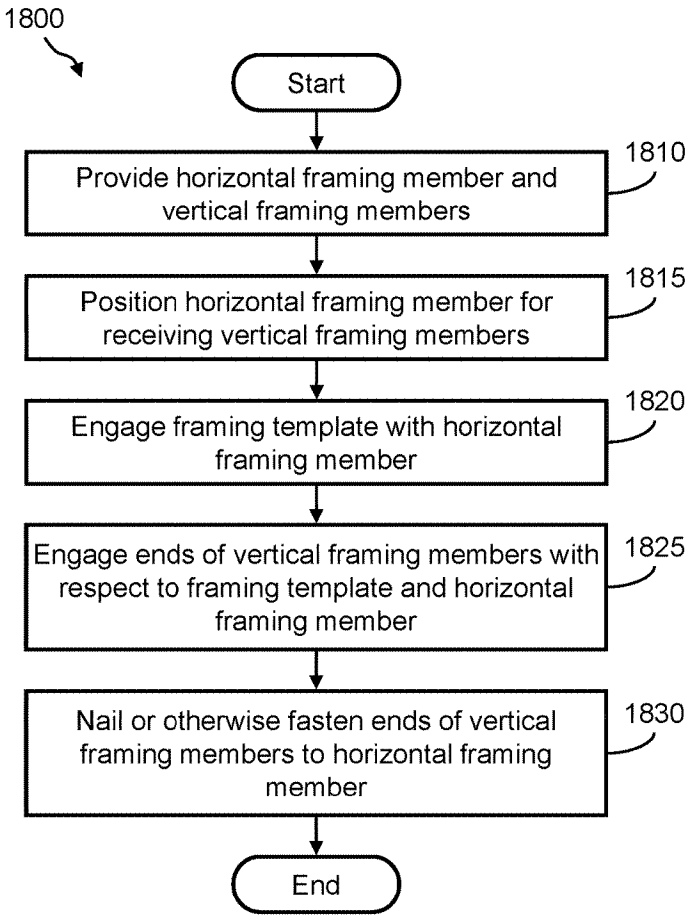

Having thus described the presently disclosed subject matter in general terms, reference will now be made to the accompanying Drawings, which are not necessarily drawn to scale, and wherein:

FIG. 1 illustrates a perspective view of a 48-inch framing template tool, which is one example of the presently disclosed framing template tool;

FIG. 2 illustrates a front view, a top view, a back view, a bottom view, and end views of the 48-inch framing template tool shown in FIG. 1;

FIG. 3 illustrates a front view and an end view of the 48-inch framing template tool shown in FIG. 1 showing example dimensions thereof;

FIG. 4 shows details of a measuring ruler provided on the 48-inch framing template tool shown in FIG. 1;

FIG. 5 illustrates a perspective view of the 48-inch framing template tool shown in FIG. 1 when in use;

FIG. 6 illustrates a perspective view of a 16-inch framing template tool, which is another example of the presently disclosed framing template tool;

FIG. 7 illustrates a perspective view of the 16-inch framing template tool shown in FIG. 6 when in use;

FIG. 8 illustrates a front view, a top view, a back view, a bottom view, and end views of the 16-inch framing template tool shown in FIG. 6;

FIG. 9 illustrates a front view and an end view of the 16-inch framing template tool shown in FIG. 6 showing example dimensions thereof;

FIG. 10 illustrates a perspective view of a 24-inch framing template tool, which is yet another example of the presently disclosed framing template tool;

FIG. 11 illustrates a perspective view of the 24-inch framing template tool shown in FIG. 10 when in use;

FIG. 12 illustrates a front view, a top view, a back view, a bottom view, and end views of the 24-inch framing template tool shown in FIG. 10;

FIG. 13 illustrates a front view and an end view of the 24-inch framing template tool shown in FIG. 10 showing example dimensions thereof;

FIG. 14 illustrates a perspective view of a 24/16-inch framing template tool, which is still another example of the presently disclosed framing template tool;

FIG. 15 illustrates a perspective view of the 24/16-inch framing template tool shown in FIG. 14 when in use;

FIG. 16 illustrates a front view, a top view, a back view, a bottom view, and end views of the 24/16-inch framing template tool shown in FIG. 14;

FIG. 17 illustrates a front view and an end view of the 24/16-inch framing template tool shown in FIG. 14 showing example dimensions thereof; and FIG. 18 illustrates a flow diagram of an example of a method of using the presently disclosed framing template tool.

DETAILED DESCRIPTION OF THE INVENTION

The presently disclosed subject matter now will be described more fully hereinafter with reference to the accompanying Drawings, in which some, but not all embodiments of the presently disclosed subject matter are shown. Like numbers refer to like elements throughout. The presently disclosed subject matter may be embodied in many different forms and should not be construed as limited to the embodiments set forth herein; rather, these embodiments are provided so that this disclosure will satisfy applicable legal requirements. Indeed, many modifications and other embodiments of the presently disclosed subject matter set forth herein will come to mind to one skilled in the art to which the presently disclosed subject matter pertains having the benefit of the teachings presented in the foregoing descriptions and the associated Drawings. Therefore, it is to be understood that the presently disclosed subject matter is not to be limited to the specific embodiments disclosed and that modifications and other embodiments are intended to be included within the scope of the appended claims.

In the following description, for purposes of explanation, numerous specific details are set forth in order to provide a thorough understanding thereof. It may be evident, however, that the novel embodiments can be practiced without these specific details. In other instances, well known structures and devices are shown in block diagram form in order to facilitate a description thereof.

In some embodiments, the presently disclosed subject matter provides a framing template tool and methods of using same in frame construction. Namely, in the process of building frame structures, such as, but not limited to, walls (e.g., partition walls), the presently disclosed framing template tool may provide a guide for positioning, for example, the ends of vertical framing members (e.g., wall studs) with respect to the horizontal framing members (e.g., top plate, sole plate).

In some embodiments, the framing template tool provides a guide for positioning framing members 16 inches apart (on center). In other embodiments, the framing template tool provides a guide for positioning framing members 24 inches apart (on center). In yet other embodiments, the framing template tool provides a guide for positioning framing members 16 inches and/or 24 inches apart (on center).

An aspect of the presently disclosed framing template tool is that it provides a tool that assists construction workers in the rapid and precise construction of frame structures, such as, but not limited to, partition walls.

Another aspect of the presently disclosed framing template tool is that it can be used to ensure proper spacing of framing members, such as, but not limited to, the proper spacing of wall studs.

Referring now to FIG. 1 is a perspective view of a 48-inch framing template tool 100, which is one example of the presently disclosed framing template tool. Also, FIG. 2 shows a front view, a top view, a back view, a bottom view, and end views of the 48-inch framing template tool 100 shown in FIG. 1. The 48-inch framing template tool 100 includes a face plate 110 and a top plate 112, wherein the top plate 112 is at an upper portion of face plate 110, and is substantially orthogonal to the face plate 110. One edge of the top plate 112 may be joined to, or formed at one edge of the face plate 110. Accordingly, the cross-section of the 48-inch framing template tool 100 is substantially L-shaped. In one example, framing template tool 100 is formed of a single piece of material and top plate 112 is formed by about a 90 degree lengthwise bend of the piece of material. Alternatively, top plate 112 may be joined to an upper edge of face plate 110 using any one of a number of techniques, including but not limited to, wielding, forming, or any other suitable technique.

Certain stud locator or alignment features are provided in the 48-inch framing template tool 100. For example, a stud locator half-slot 114 may be provided at each end of the face plate 110 of the 48-inch framing template tool 100. Essentially, the two stud locator half-slots 114 are notches on the respective ends of the face plate 110, leaving an overhang portion on each end of the top plate 112. Further, two stud locator slots 116 may be provided along the length of the face plate 110, wherein the width of the two stud locator half-slots 114 is about half the width of the two stud locator slots 116. A flap 118 may be provided on an inside edge of each of the two stud locator half-slots 114. Similarly, a flap 118 may be provided on one side of each of the two stud locator slots 116. Each of the flaps 118 preferably protrudes in a substantially orthogonal fashion from the face plate 110, wherein the flaps 118 protrude in a direction that is preferably away from the top plate 112. With respect to the two stud locator slots 116, the flap 118 can be provided on either side of the slots, not limited to the sides shown in FIG. 1 and FIG. 2. In other embodiments, both sides of each stud locator slot 116 can have a flap 118. Namely, each of the stud locator slots 116 may have two flaps 118, one on each side.

Referring now to FIG. 3 is a front view and an end view of the 48-inch framing template tool 100 shown in FIG. 1 showing example dimensions thereof. Namely, FIG. 3 shows example dimensions for a 48-inch framing template tool 100 that is configured for 2×4 (or 2×6) wall studs spaced 16 inches (on center).

In one example, the overall length of the 48-inch framing template tool 100 is about 48 inches. Namely, from end-to-end, the top plate 112 is about 48 inches long, the top plate 112 is about 1.5 inches wide, and the face plate 110 is about 3.5 inches high. For 2×4 (or 2×6) wall studs, the two stud locator slots 116 are about 1.5 inches wide and therefore the two stud locator half-slots 114 are about 0.75 inches wide. Essentially, the two stud locator half-slots 114 are 0.75-inch notches on the respective ends of the face plate 110, leaving an overhang portion of about 0.75 inches on each end of the top plate 112. Additionally, each flap 118 can be, for example, about 3.5 inches high and about 1.5 inches deep. In other embodiments, for 2×6 wall studs, the face plate 110 and the flaps 118 can be about 5.5 inches high.

Further, FIG. 3 shows the 16-inch on center spacing of the first stud locator half-slot 114 to the adjacent stud locator slot 116, the 16-inch on center spacing of the first stud locator slot 116 to the second stud locator slot 116, and the 16-inch on center spacing of the second stud locator slot 116 to the second stud locator half-slot 114. The 48-inch framing template tool 100 is designed such that multiple 48-inch framing template tools 100 can be arranged end-to-end while maintaining the 16-inch on center spacing throughout the arrangement, thus the reason for the stud locator half-slots 114 on the ends.

The 48-inch framing template tool 100 can be formed of any rigid, lightweight, durable material, such as molded plastic, metal (e.g., aluminum), or other suitable material. Additionally, FIG. 4 shows an example of a measuring ruler 120 that is provided at one end of the top plate 112 of the 48-inch framing template tool 100. In another example, a measuring ruler 120 can be provided on both ends of the 48-inch framing template tool 100, or along the entire length of the 48-inch framing template tool 100. The measuring ruler 120 may be in either of U.S. Standard or metric. The measuring ruler 120 is provided as a convenience for the user and is optional.

Referring now to FIG. 5 is a perspective view of the 48-inch framing template tool 100 shown in FIG. 1 through FIG. 5 when in use. Namely, FIG. 5 shows the 48-inch framing template tool 100 in relation to a wood frame structure 400. The wood frame structure 400 is, for example, a partition wall that is being built using 2×4 framing members. The wood frame structure 400 includes a horizontal framing member 410 (e.g., top plate or sole plate) to which multiple vertical framing members 412 (e.g., wall studs) are arranged and nailed with the assistance of the 48-inch framing template tool 100.

For example, the horizontal framing member 410 is placed on edge on the floor. Then, the 48-inch framing template tool 100 is placed atop the horizontal framing member 410 such that the top plate 112 of the 48-inch framing template tool 100 sits atop the edge of the horizontal framing member 410 and the face plate 110 of the 48-inch framing template tool 100 rests against the side face of the horizontal framing member 410. Then, the end of one vertical framing member 412 is fitted into the first stud locator half-slot 114 and against its flap 118. Then, the end of the next vertical framing member 412 is fitted into the first stud locator slot 116 and against its flap 118. Then, the end of the next vertical framing member 412 is fitted into the second stud locator slot 116 and against its flap 118. Then, the end of the next vertical framing member 412 is fitted into the second stud locator half-slot 114 and against its flap 118. The flaps 118 provide a guide for the construction worker with respect to setting the vertical framing members 412 orthogonal to the horizontal framing member 410. The stud locator half-slots 114 and the stud locator slot 116 provide a guide for the construction worker with respect to ensuring the correct spacing of the vertical framing members 412. Once the vertical framing members 412 are properly engaged with the features of the 48-inch framing template tool 100, the ends of the vertical framing members 412 can be nailed or otherwise fastened to the horizontal framing member 410.

Referring now to FIG. 6 is a perspective view of a 16-inch framing template tool 600, which is another example of the presently disclosed framing template tool. In this example, the 16-inch framing template tool 600 is designed to engage the horizontal framing member and two vertical framing members, as shown in FIG. 7. FIG. 8 shows a front view, a top view, a back view, and a bottom view of the 16-inch framing template tool 600 shown in FIG. 6. FIG. 9 shows a front view and an end view of the 16-inch framing template tool 600 shown in FIG. 6 showing example dimensions thereof. Namely, FIG. 6 shows the dimensions for a 16-inch framing template tool 600 that is configured for 2×4 (or 2×6) wall studs spaced 16 inches apart (on center). The 16-inch framing template tool 600 can be formed of any rigid, lightweight, durable material, such as molded plastic, metal (e.g., aluminum), or other suitable material. The 16-inch framing template tool 600 is designed such that multiple 16-inch framing template tools 600 can be arranged end-to-end.

Referring now to FIG. 10 is a perspective view of a 24-inch framing template tool 1000, which is yet another example of the presently disclosed framing template tool. In this example, the 24-inch framing template tool 1000 is designed to engage the horizontal framing member and two vertical framing members, as shown in FIG. 11. FIG. 12 shows a front view, a top view, a back view, and a bottom view of the 24-inch framing template 1000 shown in FIG. 10. FIG. 13 shows a front view and an end view of the 24-inch framing template 1000 shown in FIG. 10 showing example dimensions thereof. Namely, FIG. 13 shows the dimensions for a 24-inch framing template 1000 that is configured for 2×4 (or 2×6) wall studs spaced 24 inches apart (on center). The 24-inch framing template tool 1000 can be formed of any rigid, lightweight, durable material, such as molded plastic, metal (e.g., aluminum), or other suitable material. The 24-inch framing template tool 1000 is designed such that multiple 24-inch framing template tools 1000 can be arranged end-to-end.

Referring now to FIG. 14 is a perspective view of a 24/16-inch framing template tool 1400, which is still another example of the presently disclosed framing template tool. In this example, the 24/16-inch framing template tool 1400 is designed to engage the horizontal framing member and three vertical framing members, as shown in FIG. 15.

FIG. 16 shows a front view, a top view, a back view, and a bottom view of the 24/16-inch framing template tool 1400 shown in FIG. 14. FIG. 17 shows a front view and an end view of the 24/16-inch framing template tool 1400 shown in FIG. 14 showing example dimensions thereof. Namely, FIG. 17 shows the dimensions for a 24/16-inch framing template tool 1400 that is configured for 2×4 (or 2×6) wall studs spaced 16 and/or 24 inches apart (on center). The 24/16-inch framing template tool 1400 can be formed of any rigid, lightweight, durable material, such as molded plastic, metal (e.g., aluminum), or other suitable material. The 24/16-inch framing template tool 1400 is designed such that multiple 24/16-inch framing template tools 1400 can be arranged end-to-end.

Referring now to FIG. 18 is a flow diagram of an example of a method 1800 of using the presently disclosed framing template tool. The method 1800 may include, but is not limited to, the following steps.

At a step 1810, the horizontal framing member and the vertical framing members are provided at the construction site. In one example, the horizontal framing member 410 and multiple vertical framing members 412 are provided for building the wood frame structure 400 shown, for example, in FIG. 5, FIG. 7, FIG. 11, and FIG. 15.

At a step 1815, the horizontal framing member is positioned for receiving the vertical framing members. For example, in the wood frame structure 400, the horizontal framing member 410 is placed on edge on the floor.

At a step 1820, the framing template tool is engaged with the horizontal framing member. In one example and referring now to FIG. 5, the 48-inch framing template tool 100 is placed atop the horizontal framing member 410 such that the top plate 112 of the 48-inch framing template tool 100 sits atop the edge of the horizontal framing member 410 and the face plate 110 of the 48-inch framing template tool 100 rests against the side face of the horizontal framing member 410.

At a step 1825, the ends of the vertical framing members are engaged with the framing template tool and respect to the horizontal framing member. In one example and referring again to FIG. 5, the end of one vertical framing member 412 is fitted into the first stud locator half-slot 114 and against its flap 118. Then, the end of the next vertical framing member 412 is fitted into the first stud locator slot 116 and against its flap 118. Then, the end of the next vertical framing member 412 is fitted into the second stud locator slot 116 and against its flap 118. Then, the end of the next vertical framing member 412 is fitted into the second stud locator half-slot 114 and against its flap 118.

At a step 1830, the ends of the vertical framing members are nailed or otherwise fastened to the horizontal framing member. In one example and referring again to FIG. 5, once the vertical framing members 412 are properly engaged with the features of the 48-inch framing template tool 100, the ends of the vertical framing members 412 can be nailed or otherwise fastened to the horizontal framing member 410.

In the method 1800, the stud locator half-slots 114 and the stud locator slot 116 of the framing members provide a guide for the construction worker with respect to ensuring the correct spacing of the vertical framing members. The flaps 118 of the framing members provide a guide for the construction worker with respect to setting the vertical framing members orthogonal to the horizontal framing member.

The presently disclosed framing template tool is not limited to the configurations shown and described herein with reference to FIG. 1 through FIG. 18. These configurations are exemplary only. For example, the overall length of the framing template tool can vary, the number of vertical framing members to which the framing template tool can be engaged can vary, the relative spacing of the stud locator half-slots 114 and the stud locator slot 116 of the framing template tool can vary, and the dimensions of the features of the framing template tool can vary depending on the dimensions of the framing members for which it will be used.

The terms "top," "bottom," "over," "under," and "on" are used throughout the description with reference to the relative positions of components of the framing templates, such as relative positions of the face plate 110, the top plate 112, and the flaps 118 of the framing templates. It will be appreciated that the framing templates are functional regardless of their orientation in space.

Following long-standing patent law convention, the terms "a," "an," and "the" refer to "one or more" when used in this application. Thus, for example, reference to "a subject" includes a plurality of subjects, unless the context clearly is to the contrary (e.g., a plurality of subjects), and so forth.

Throughout this specification, the terms "comprise," "comprises," and "comprising" are used in a non-exclusive sense, except where the context requires otherwise. Likewise, the term "include" and its grammatical variants are intended to be non-limiting, such that recitation of items in a list is not to the exclusion of other like items that can be substituted or added to the listed items.

For the purposes of this specification and figures, unless otherwise indicated, all numbers expressing amounts, sizes, dimensions, proportions, shapes, formulations, parameters, percentages, parameters, quantities, characteristics, and other numerical values used in the specification and claims, are to be understood as being modified in all instances by the term "about" even though the term "about" may not expressly appear with the value, amount or range. Accordingly, unless indicated to the contrary, the numerical parameters set forth in the following specification and attached claims are not and need not be exact, but may be approximate and/or larger or smaller as desired, reflecting tolerances, conversion factors, rounding off, measurement error and the like, and other factors known to those of skill in the art depending on the desired properties sought to be obtained by the presently disclosed subject matter. For example, the term "about," when referring to a value can be meant to encompass variations of, in some embodiments, ±100% in some embodiments ±50%, in some embodiments ±20%, in some embodiments ±10%, in some embodiments ±5%, in some embodiments ±1%, in some embodiments ±0.5%, and in some embodiments ±0.1% from the specified amount, as such variations are appropriate to perform the disclosed methods or employ the disclosed compositions.

Further, the term "about" when used in connection with one or more numbers or numerical ranges, should be understood to refer to all such numbers, including all numbers in a range and modifies that range by extending the boundaries above and below the numerical values set forth. The recitation of numerical ranges by endpoints includes all numbers, e.g., whole integers, including fractions thereof, subsumed within that range (for example, the recitation of 1 to 5 includes 1, 2, 3, 4, and 5, as well as fractions thereof, e.g., 1.5, 2.25, 3.75, 4.1, and the like) and any range within that range.

Although the foregoing subject matter has been described in some detail by way of illustration and example for purposes of clarity of understanding, it will be understood by those skilled in the art that certain changes and modifications can be practiced within the scope of the description herein.

What is claimed is:

1. A framing tool, comprising:

a. a face plate;

b. a top plate joined to the face plate at about an edge thereof, wherein the top plate is substantially orthogonal to the face plate; and c. alignment features, comprising:

i. slots formed in the face plate along its length; and ii. one or more flaps joined to at least one edge of each of the slots, wherein each of the flaps protrude in a substantially orthogonal fashion from the face plate and in a direction away from the top plate.

2. The framing tool of claim 1 further comprising a half slot formed at opposing ends of the face plate, wherein the half slot at each end of the face plate leaves an overhang portion on each end of the top plate.

3. The framing tool of claim 2 wherein each half slot comprises a flap joined to an edge of each half slot, and wherein each flap protrudes in a substantially orthogonal fashion from the face plate and in a direction away from the top plate.

4. The framing tool of claim 2 wherein each half slot is about half the width of the slots formed in the face plate along its length.

5. The framing tool of claim 2 wherein the overhang portion extends out about 0.75 inches from each end of the face plate.

6. The framing tool of claim 1 wherein the one or more flaps are joined to at least one vertical edge of each of the slots.

7. The framing tool of claim 1 wherein the slots comprise about a 16-inch on center spacing from one another.

8. The framing tool of claim 2 wherein from each end of the top plate to a center point of its next adjacent slot is one of about 16 inches or about 24 inches.

9. The framing tool of claim 1 wherein the face plate is about 3.5 inches tall, the top plate is about 1.5 inches wide, the one or more flaps are about 3.5 inches tall and protrude about 1.5 inches out from a surface of the face plate, and the slots are about 1.5 inches wide.

10. The framing tool of claim 1 wherein the face plate is about 5.5 inches tall, the top plate is about 1.5 inches wide, the one or more flaps are about 5.5 inches tall and protrude about 1.5 inches out from a surface of the face plate, and the slots formed in the face plate are about 1.5 inches wide.

11. The framing tool of claim 1 further comprising measuring indicia on at least a portion of one of the top plate and face plate.

12. The framing tool of claim 1 wherein the slots are configured and spaced for placement of 2×4 and/or 2×6 wall studs at a spacing of about 16-inches on center.

13. The framing tool of claim 1 wherein the slots are configured and spaced for placement of 2×4 and/or 2×6 wall studs at a spacing of about 24-inches on center.

14. The framing tool of claim 1 wherein the slots are configured and spaced for placement of at least one set of 2×4 and/or 2×6 wall studs at a spacing of about 16-inches on center and at least one set of 2×4 and/or 2×6 wall studs at a spacing of about 24-inches on center.

15. The framing tool of claim 1 wherein an overall length of the framing tool is one of about 16 inches, 24 inches, or 48 inches.

16. The framing tool of claim 1 wherein the slots comprise two half slots one formed at each end of the face plate, wherein the half slot at each end of the face plate leaves an overhang portion on each end of the top plate, wherein each of the two half slots comprise a flap joined to an edge of each half slot, and wherein each flap protrudes in a substantially orthogonal fashion from the face plate and in a direction away from the top plate.

17. The framing tool of claim 16 wherein a length of the top plate is about 16-inches and a length of the face plate is about 14.5 inches.

18. The framing tool of claim 16 wherein a length of the top plate is about 24-inches and a length of the face plate is about 22.5 inches.

19. The framing tool of claim 16 wherein a length of the top plate is about 48-inches and a length of the face plate is about 46.5 inches.

20. A method of using a framing tool, the method comprising:

a. engaging a framing tool with a horizontal framing member, wherein the framing tool comprises:
   i. a face plate;
   ii. a top plate joined to the face plate at about an edge thereof, wherein the top plate is substantially orthogonal to the face plate; and
   iii. alignment features, comprising:
      1. slots formed in the face plate along its length; and
      2. one or more flaps joined to at least one edge of each of the slots, wherein each of the flaps protrude in a substantially orthogonal fashion from the face plate and in a direction away from the top plate;

b. engaging ends of vertical framing members with respect to the framing tool; and c. fastening ends of the vertical framing members to the horizontal framing member.

* * * * *